US006267658B1

(12) United States Patent
Ali et al.

(10) Patent No.: US 6,267,658 B1
(45) Date of Patent: Jul. 31, 2001

(54) SANDING BLOCK

(75) Inventors: Terry Ali; Christopher Ali; Phillip Glenn Ali, all of Fairborn, OH (US)

(73) Assignee: Ali Industries, Inc., Fairborn, OH (US)

( * ) Notice: Subject to any disclaimer, the term of this patent is extended or adjusted under 35 U.S.C. 154(b) by 0 days.

(21) Appl. No.: 09/376,949

(22) Filed: Aug. 18, 1999

(51) Int. Cl.[7] ..... B24D 15/00
(52) U.S. Cl. ..... 451/523; 451/524
(58) Field of Search ..... 451/523, 524, 451/525, 540, 550, 354

(56) References Cited

U.S. PATENT DOCUMENTS 4,221,084 * 9/1980 Frantzen ..... 451/524
4,484,419 * 11/1984 Freerks ..... 451/523
4,922,665 * 5/1990 Wanatowicz ..... 451/524
5,054,248 * 10/1991 Thayer ..... 451/524
5,313,746 * 5/1994 Zarriello ..... 451/524
5,662,519 * 9/1997 Arnold ..... 451/523
5,902,176 * 5/1999 Chen ..... 451/524

* cited by examiner

*Primary Examiner*—Derris H. Banks
(74) *Attorney, Agent, or Firm*—R. William Graham

(57) ABSTRACT

A sanding block for hand held use wherein said sanding block comprises a base having a top surface, four side walls and a substantially flat bottom for receiving a sheet of sandpaper; and a handle protruding from the top surface of the base, the handle having a front end and a back end designed to conform to the palm of a user. The handle is ergonomically designed such that it is symmetrically oriented along a longitudinal axis which aligns with two diametrically opposed corners of the base.

19 Claims, 1 Drawing Sheet

Fig. 1
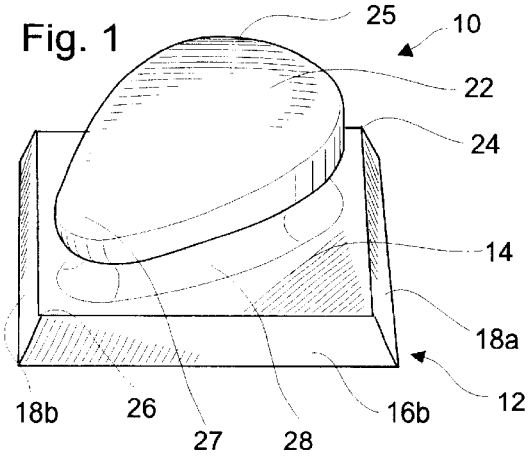
Fig. 4
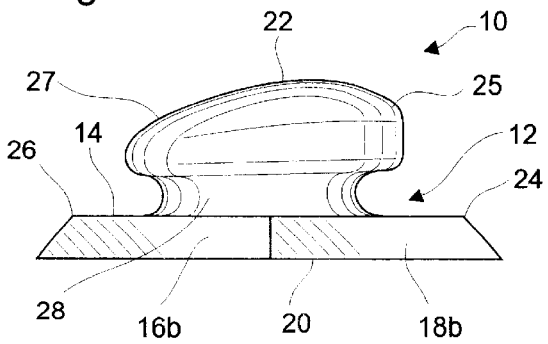
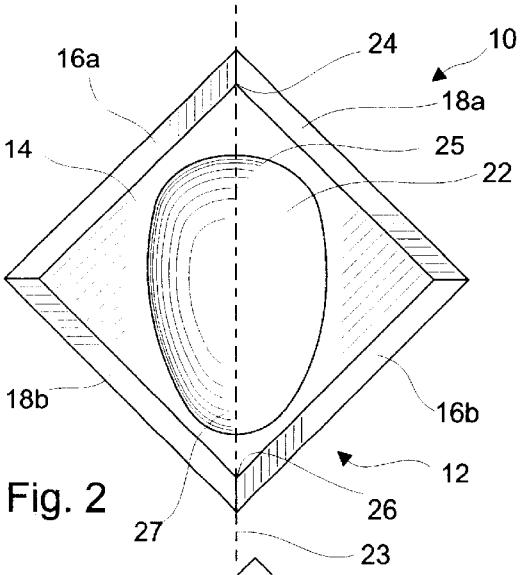
Fig. 2
Fig.5
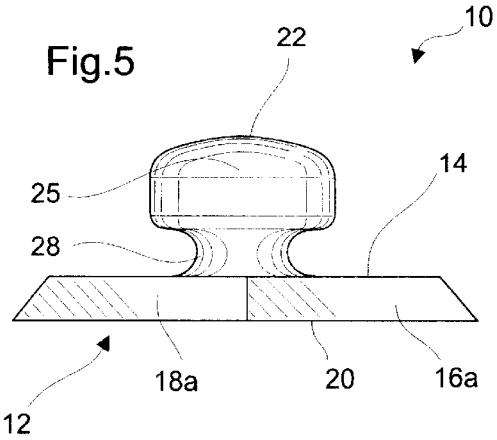
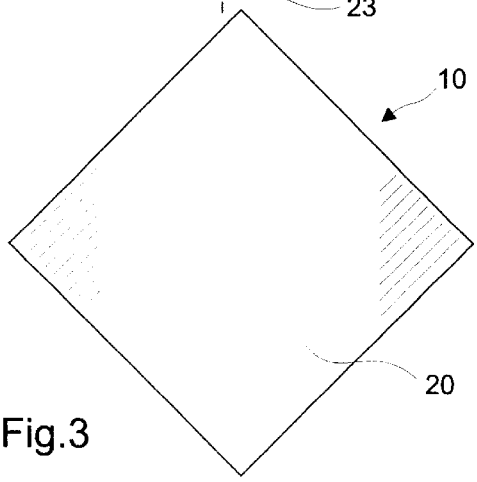
Fig.3
Fig.6
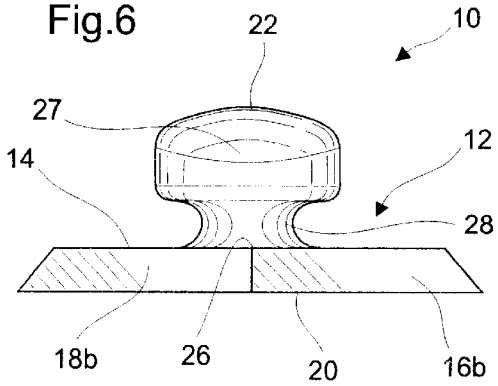

SANDING BLOCK

BACKGROUND OF THE INVENTION

1. Filed of the Invention

The invention relates generally to the field of sanding devices. More particularly, but not way of limitation, the present invention relates to improvements in sanding blocks.

2. Related Art

There presently exists a variety of styles of sanding blocks. These sanding blocks are generally integrally formed of rubber and typically include a first member having an intermediate portion and a pair of ends wherein a top surface of the first member is configured to be hand held and a bottom surface of each of the ends has retention surfaces therein and a second member having an intermediate portion and a pair of ends wherein a top surface of the first member is configured to be hand held and a bottom surface of each of the ends has retention surfaces therein and a second member having an intermediate portion connected to the intermediate portion of the first member and a pair of ends wherein a top surface of each end of the second member has a plurality of nails complimentary formed to respectively seat in one of the retention open surfaces. The respective first ends must be pried apart such that the nails are removed from the retention surfaces so that an end of a piece of sandpaper to hold the same in place. The second ends are likewise manipulated to retain the other end of the sandpaper.

Present sanding blocks have not, however, evolved to meet the needs of the user. For instance, it is desirable to minimize fatigue to the user while maintaining the effectiveness of the sanding block. Such sanding blocks are presently formed with a smooth surface. Also, the rubber material employed in these blocks is relatively rigid, dense and heavy and difficult for the user to pry apart. This is particularly true for woman which are increasingly entering into the do-it-yourself market. Also, women find it difficult to use the present sanding block without breaking their finger nails.

The present invention overcomes these deficiencies of present sanding blocks. The present invention also meets the needs of present day consumer.

BRIEF SUMMARY OF THE INVENTION

It is an object of the invention to provide an ergonomically improved sanding block.

It is another object of the invention to enhance the ease of use of a sanding block while maintaining effectiveness of the same.

In accordance with the present invention a sanding block comprises a base, said base comprising a top surface, a bottom surface having a substantially flat surface for receiving and retaining a sheet of sandpaper, and four sides which represent the perimeter of the base; and a handle which protrudes, preferably centrally, from the top surface of the base. The handle has a front end and a disproportionate back end and is generally of a pear shape which conforms to the palm of a user's hand. The handle is ergonomically designed, being symmetrically oriented along a longitudinal axis which aligns with diametrically opposed corners of the base. The shape of the handle and the orientation of the handle, with respect to the base of the present sanding block, are designed such that the sanding block and the user can interact most efficiently and safely.

Furthermore, the act of sanding causes less fatigue to the person doing the sanding and the sanding operation is performed in a more consistent and uniform manner.

Other objects and advantages will be readily apparent to those skilled in the art upon reviewing the drawings and the detailed description which follows:

BRIEF DESCRIPTION OF THE DRAWINGS

FIG. 1 is a perspective view of a sanding block of the present invention;

FIG. 2 is top view of the sanding block of the present invention;

FIG. 3 is bottom view of the sanding block of the present invention;

FIG. 4 is a side view of the sanding block of the present invention,

FIG. 5 is an end view of the sanding block of the present invention; and

FIG. 6 is another end view of the sanding block of the present invention,

DETAILED DESCRIPTION OF THE INVENTION

Referring now to the drawings shown in FIGS. 1–6, the sanding block of the invention is generally referred to by the numeral 10. The sanding block 10 has a base 12 which has a top surface 14, a first pair of side members 16*a* and 16*b*, a second pair of side members 18*a* and 18*b* oriented perpendicular to side members 16*a* and 16*b*, and a bottom surface 20 which lies in a plane generally parallel to the top surface 14. The sanding block 10 also has a handle 22 centrally disposed and protruding upward from the base 12.

The handle 22 is shaped to be hand held, more particularly, the handle 22 is pear shaped so that it conveniently rests in the palm of a user's hand. As illustrated in FIGS. 1–6 and particularly in FIGS. 1 and 6, the handle 22 is geometrically designed so that it lies symmetrically oriented along a longitudinal axis 23 which aligns with two diametrically opposed corners 24 and 26 of the base 12. The handle 22 is generally eccentrically shaped having a large end 25 disposed adjacent comer 24 and a relatively smaller end 27 disposed adjacent corner 26. The sanding block 10 further has sides 31 and 33 laterally spaced from two diameterically opposed corners 35 and 37, respectively, leaving substantial portions 39 and 41, respectively, of top surface 14 between each side 31 and 33 and said respective opposing corner 35 and 37. This permits one's hand and fingers to grip the handle 22 in a way such that one's fingers extend about the sides 31 and 33 and over top surface portions 39 and 41 without exceeding a periphery of the base 12.

A neck portion 28 interconnects the handle 22 and base 12. The rich portion 28 is of a small diameter than the handle 22 and raises the handle 22 sufficiently from the base such that the user can grip about the handle 22 with one's fingers and or thumb disposed in a recessed area formed below the handle 22 adjacent the neck 28.

The sanding block 10 is generally square shaped. However, one pair of sides may be longer in length than the other pair of sides such that the sanding block 10 has a generally rectangular shape. While the side walls of the sanding block base may be squared at about 90° from the top and bottom surfaces of the base, they are generally beveled to be more effective in reaching underlying areas to be sanded. Each side member 16*a*, 16*b*, 18*a*, and 18*b* are shown here to be generally trapezoidal in shape.

The sanding block 10 can be manufactured from any of the commonly used materials used to make sanding blocks such as wood, plastic, rubber, and the like. Preferably, the invention is molded as a one piece structure which is preferably made of a polymeric material such as rubber or other polymer e.g., a polyurethane foam. In a particularly preferred aspect of the invention the sanding block 10 is integrally formed from rubber foam using a molding process.

The bottom surface of the base of the sanding block is flat in its orientation but may contain a design such as raised areas, e.g., ridges, contoured sections, etc. which are designed to optimize retention of the sandpaper thereto. For example, when utilizing an adhesive, the raised areas provide voids and seats which improve the effectiveness of the adhesive by increasing the total surface area of the bottom surface. Alternatively, the adhesive may be applied to the back of the sandpaper sheet and the sandpaper sheet is then placed in contact with the bottom surface of the sanding block. Preformed "sticky" sandpaper sheets are commercially available from various retail hardware supply stores such as Home Depot, Ace hardware, Sears, Lowe's, etc. Typically, the adhesive surface is covered with a release cover sheet which is easily removed from the "sticky" sandpaper sheet prior to use.

Other methods may be used for adhering or attaching the sandpaper sheet to the bottom surface of the base of the sanding block. For example, the bottom surface of the base of the sanding block may be manufactured or adapted to exhibit a hook/loop surface which can mate with a corresponding hook/loop surface on the back side of a sandpaper sheet.

The above described embodiment is set forth to exemplify the invention and is in no way meant to limit the present invention. It will be readily apparent to those skilled in the art that various modifications, derivations and variations can be made to material and to structure without despairing from scope or essence of the invention. Accordingly, the appended claims should be read in their full scope including any such modifications, derivations and variations.

What is claimed is:

1. A sanding block for hand held use, said sanding block comprising:

a base having a top surface, and a substantially flat and generally rectangular bottom for receiving a sheet of sandpaper; and a handle protruding from the top surface of said base wherein said handle has a front end and a back end designed to conform to the palm of a user, said handle being ergonomically designed such that said handle is symmetrically oriented along a longitudinal axis which aligns with a first pair of two diametrically opposed corners of said base, and wherein said handle is eccentrically shaped having a large end and a relatively smaller end wherein each said end is disposed along said diametrically opposed corners along said longitudinal axis and having sides laterally spaced from a second pair of two diametrically opposed corners leaving substantial portions of top surface between each said side and said respective opposing corner to permit one's hand and fingers to grip said handle in a way such that one's fingers extend about said sides and over said top surface portions without exceeding a periphery of said base.

2. The sanding block of claim 1 wherein said sanding block is molded from a rubber material.

3. The sanding block of claim 1 wherein said sanding block is a polymeric material.

4. The sanding block of claim 3 wherein said polymeric material is polyurethane.

5. The sanding block of claim 4 wherein said polymeric material is polyurethane Foam.

6. The sanding block of claim 1 wherein said handle is pear-shaped.

7. The sanding block of claim 6, wherein said handle is generally centrally disposed on said top.

8. The sanding block of claim 1 wherein said bottom surface includes means for retaining a sheet of sandpaper thereto.

9. The sanding block of claim 8 wherein said means for retaining said sheet of sandpaper comprises hook/loop means which interact with corresponding hook/loop means on said sheet of sandpaper.

10. The sanding block of claim 1 wherein said bottom surface is designed to retain a sheet of sandpaper having a sticky surface opposite a sanding surface.

11. The sanding block of claim 1 wherein said bottom surface is coated with an adhesive for adhering said sheet of sandpaper.

12. The sanding block of claim 1 wherein said base includes four side walls, wherein said sidewalls are beveled.

13. The sanding block of claim 1 wherein said base includes four side walls, wherein said sidewalls are substantially equal in length, said bottom of said base being geometrically square.

14. The sanding block of claim 1 wherein said base includes four side walls, wherein said four sidewalls are composed of a first pair of parallel side walls and a second pair of paralleled side walls, said first pair of parallel side walls extending perpendicular to said second pair of parallel side walls.

15. The sanding block of claim 14 wherein said first pair of parallel side walls and said second pair of parallel side walls are substantially equal in length such that said bottom of said base is substantially square in shape.

16. The sanding block of claim 1, wherein said base includes four sidewalls wherein each side wall is generally trapezoidal in shape.

17. The sanding block of claim 1, which further includes a neck interconnecting said handle and said base, wherein said neck is smaller in diameter then said handle to form a recessed surface between said handle and said base.

18. The sanding block of claim 17 wherein said handle, said neck, and said base are integrally formed.

19. The sanding block of claim 1, which further includes a neck interconnecting said handle and said base, wherein said neck is smaller in diameter then said handle to form a recessed surface between said handle and said base.

* * * * *

UNITED STATES PATENT AND TRADEMARK OFFICE

CERTIFICATE OF CORRECTION

PATENT NO. : 6,267,658 B1
APPLICATION NO. : 09/376949
DATED : July 31, 2001
INVENTOR(S) : Ali et al.

It is certified that error appears in the above-identified patent and that said Letters Patent is hereby corrected as shown below:

The title page, showing an illustrative figure, should be deleted and substitute therefore the attached title page.

Delete the drawing sheet containing figures 1, 2,3,4,5 & 6 and substitute therefore the attached sheet containing figures 1, 2,3,4,5 & 6.

Signed and Sealed this

Twenty-sixth Day of February, 2008

JON W. DUDAS
*Director of the United States Patent and Trademark Office*

(12) United States Patent
Ali et al.

(10) Patent No.: US 6,267,658 B1
(45) Date of Patent: Jul. 31, 2001

(54) SANDING BLOCK

(75) Inventors: Terry Ali; Christopher Ali; Phillip Glenn Ali, all of Fairborn, OH (US)

(73) Assignee: Ali Industries, Inc., Fairborn, OH (US)

( * ) Notice: Subject to any disclaimer, the term of this patent is extended or adjusted under 35 U.S.C. 154(b) by 0 days.

(21) Appl. No.: 09/376,949

(22) Filed: Aug. 18, 1999

(51) Int. Cl.[7] ..... B24D 15/00
(52) U.S. Cl. ..... 451/523; 451/524
(58) Field of Search ..... 451/523, 524, 451/525, 540, 550, 354

(56) References Cited

U.S. PATENT DOCUMENTS 4,221,084 * 9/1980 Frantzen ..... 451/524
4,484,419 * 11/1984 Freerks ..... 451/523
4,922,665 * 5/1990 Wanatowicz ..... 451/524
5,054,248 * 10/1991 Thayer ..... 451/524
5,313,746 * 5/1994 Zarriello ..... 451/524
5,662,519 * 9/1997 Arnold ..... 451/523
5,902,176 * 5/1999 Chen ..... 451/524

* cited by examiner

*Primary Examiner*—Derris H. Banks
(74) *Attorney, Agent, or Firm*—R. William Graham

(57) ABSTRACT

A sanding block for hand held use wherein said sanding block comprises a base having a top surface, four side walls and a substantially flat bottom for receiving a sheet of sandpaper; and a handle protruding from the top surface of the base, the handle having a front end and a back end designed to conform to the palm of a user. The handle is ergonomically designed such that it is symmetrically oriented along a longitudinal axis which aligns with two diametrically opposed corners of the base.

19 Claims, 1 Drawing Sheet

Fig. 1

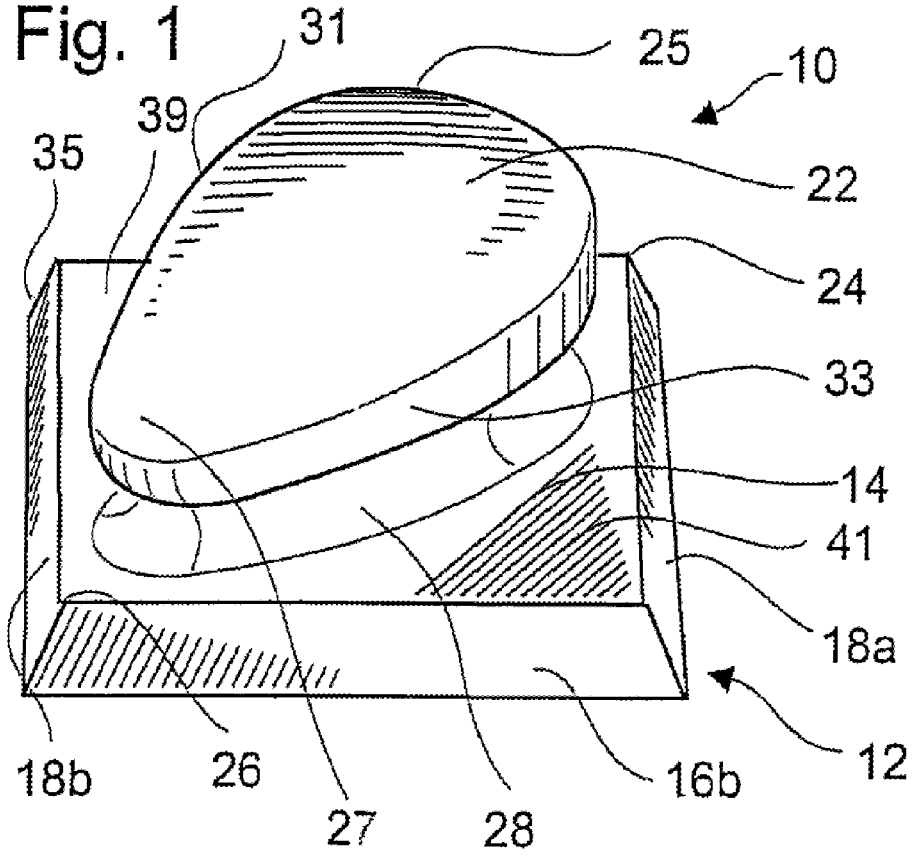

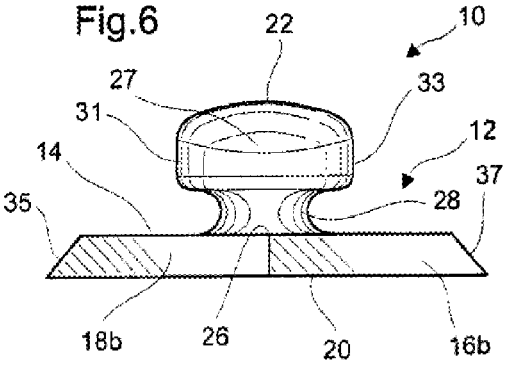

U.S. Patent Jul. 31, 2001 Sheet 1 of 1 6,267,658 B1
Fig. 1
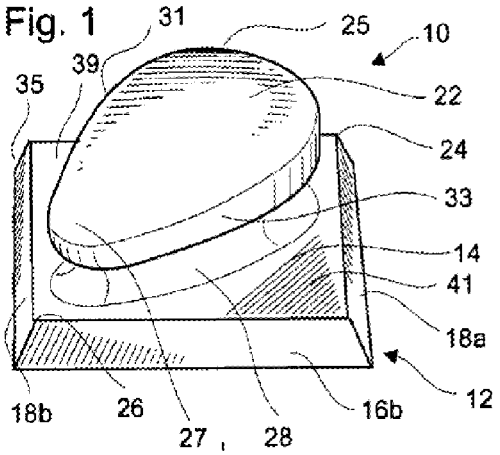
Fig. 4
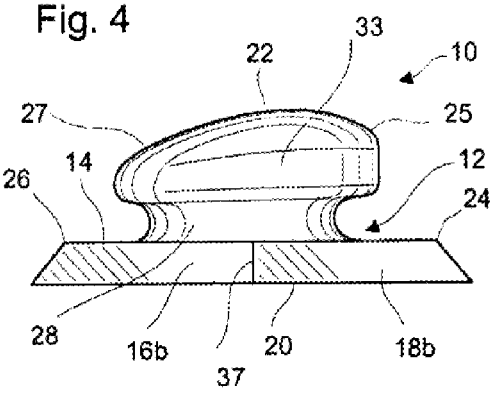
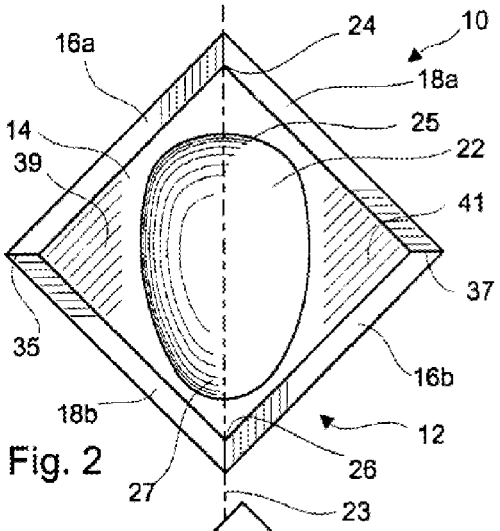
Fig. 2
Fig.5
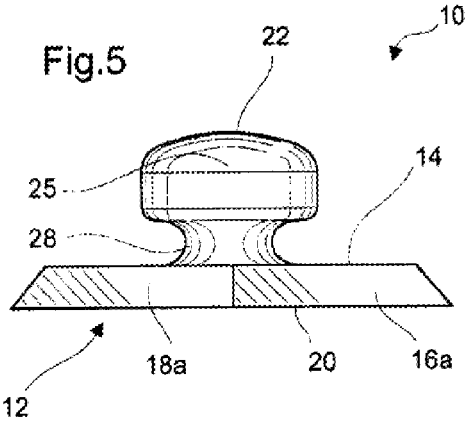
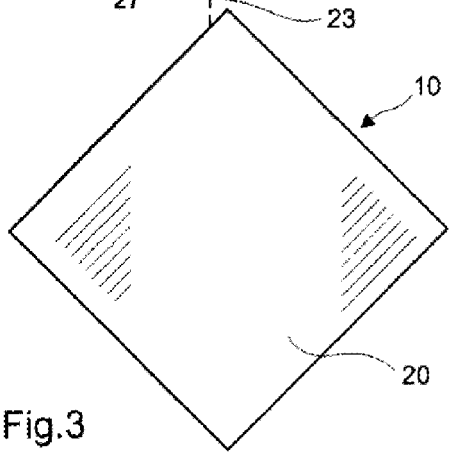
Fig.3
Fig.6